US006182961B1

(12) United States Patent
Wenth, Jr.

(10) Patent No.: US 6,182,961 B1
(45) Date of Patent: Feb. 6, 2001

(54) DUPLEX DOCUMENT RETARD SEPARATION AND FEEDING WITH REDUCED IMAGE SMUDGING

(75) Inventor: Stephen J. Wenth, Jr., West Henrietta, NY (US)

(73) Assignee: Xerox Corporation, Stamford, CT (US)

( * ) Notice: Under 35 U.S.C. 154(b), the term of this patent shall be extended for 0 days.

(21) Appl. No.: 09/212,643

(22) Filed: Dec. 16, 1998

(51) Int. Cl.[7] ..... B65H 3/06

(52) U.S. Cl. ..... 271/114; 271/121; 271/10.11; 271/258.03; 271/225; 271/124; 271/263

(58) Field of Search ..... 271/121, 124, 271/125, 10.11, 10.09, 225, 902, 259, 258.03, 262, 123, 10.02, 10.04, 114

(56) References Cited

U.S. PATENT DOCUMENTS

| | | | | |
|---|---|---|---|---|
| 3,937,453 | | 2/1976 | Hickey et al. | 271/4 |
| 4,909,498 | * | 3/1990 | Rutishauser | 271/10.04 |
| 4,925,177 | * | 5/1990 | Nakamura et al. | 271/110 |
| 4,928,948 | * | 5/1990 | Evangelista et al. | 271/110 |
| 5,076,563 | * | 12/1991 | Namba et al. | 271/10.09 |
| 5,085,420 | * | 2/1992 | Sata | 271/114 |
| 5,199,696 | * | 4/1993 | Kato | 271/10.13 |
| 5,240,241 | * | 8/1993 | Kawazoe | 271/114 |
| 5,316,285 | | 5/1994 | Olson et al. | 271/122 |
| 5,461,468 | | 10/1995 | Dempsey et al. | 355/316 |
| 5,593,150 | * | 1/1997 | Katayanagi et al. | 271/121 |
| 5,594,486 | * | 1/1997 | Kiyohara | 347/104 |
| 5,622,363 | * | 4/1997 | Beaudreau et al. | 271/110 |
| 5,867,196 | * | 2/1999 | Kiyohara et al. | 347/104 |
| 5,951,180 | * | 9/1999 | Kawaura | 400/629 |
| 5,982,400 | * | 11/1999 | Yokoi et al. | 346/134 |

FOREIGN PATENT DOCUMENTS

| | | | | |
|---|---|---|---|---|
| 2-132027 | * | 5/1990 | (JP) | 271/121 |
| 404256650 | * | 9/1992 | (JP) | 271/121 |
| 405301648 | * | 11/1993 | (JP) | 271/121 |

* cited by examiner

*Primary Examiner*—Christopher P. Ellis
*Assistant Examiner*—Richard Ridley

(57) ABSTRACT

The disclosure relates to separating and feeding previously printed document sheets from a stack with reduced inter-sheet document image smearing using a retard-type sheet separator-feeder. For duplex documents, the intermittent drive system for the retard feeder drives the sheet being fed downstream out of the retard nip for only a short initial feeding distance which is only a minor portion of the document dimension, then reverse drives the sheet in the upstream direction for only a short reverse distance sufficient to eject all the sheets from the retard nip other then the one being fed out. Meanwhile a nudger system feeding sheets from the stack to the retard nip is disengaged. Then the feeder is driven in the downstream sheet feeding direction again, but for a much longer sheet feeding distance, Thus, the sheet being fed by the retard feeder may be fed out of the retard nip without duplex document image smearing against other sheets in the retard nip.

6 Claims, 3 Drawing Sheets

DUPLEX DOCUMENT RETARD SEPARATION AND FEEDING WITH REDUCED IMAGE SMUDGING

Figure 1:
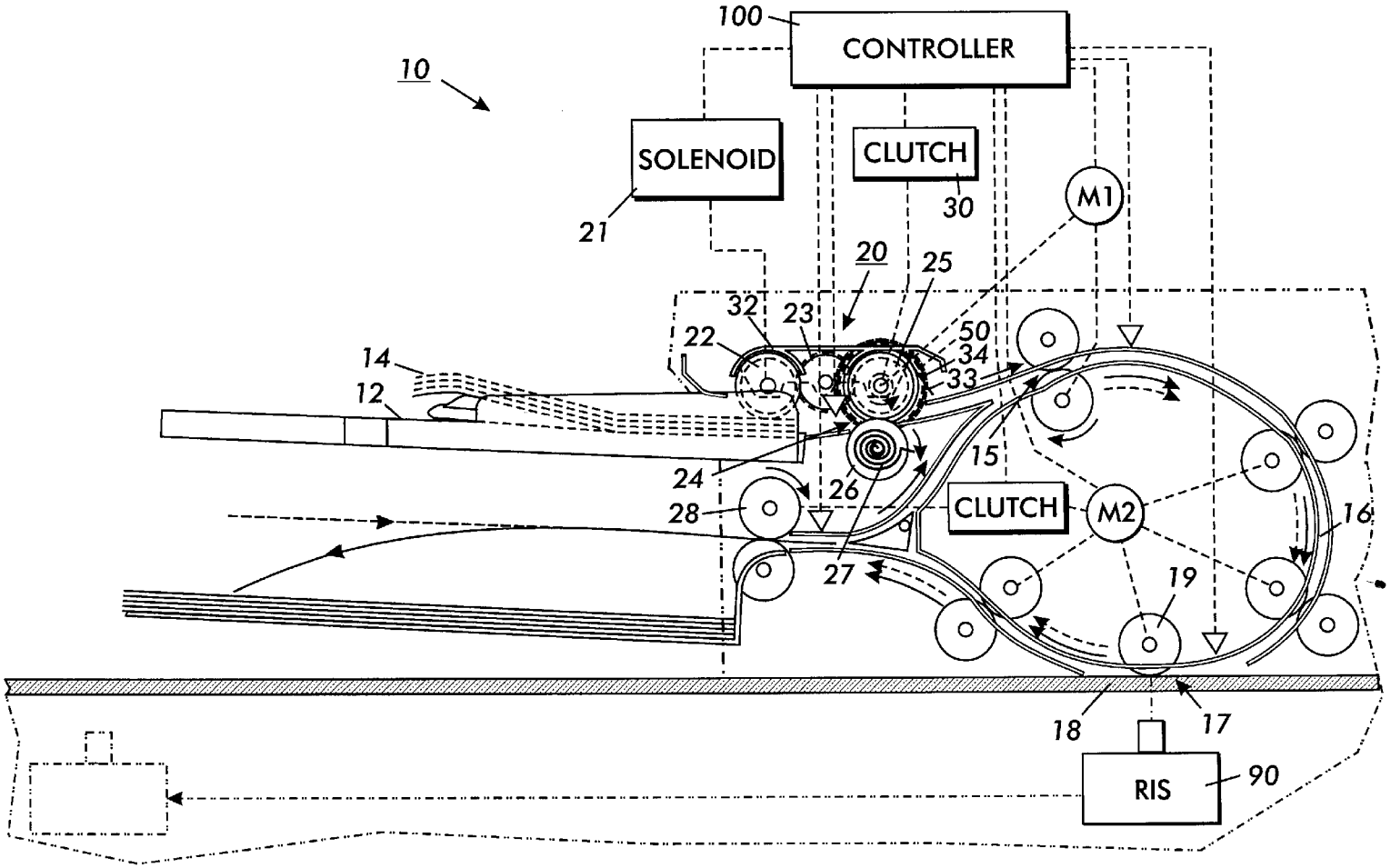

Cross-reference and incorporation by reference is made to copending, commonly assigned, U.S. Pat. applications No. 09/191,357, filed Nov. 13, 1998 now U.S. Pat. No. 5,978,622, issued Nov. 2, 1999, and 09/152,120, filed Sep. 14, 1998 now U.S. Pat. No. 6,059,279, issued May 9, 2000, both by the same Stephen J. Wenthe, Jr., and entitled, respectively, "Moving Document Imaging System with Retard Separator Wear Debris Attractant Shield System", and "Retard Sheet Separator-Feeder With Retarded Sheets Kickback Reduction".

Typical flimsy sheets of paper or the like image bearing substrates which have been printed on both sides, commonly referred to as duplex documents, are becoming increasingly common, particularly as environmental concerns lead to greater use of duplex printing and copying reproduction machines. Automatic duplex printing preset default modes in newer machines encourage more such duplexing. The various different types of papers, inks and imaging systems which may be used in duplex printing, e.g., xerographic, ink jet, ink ribbons, offset, etc., and their release agents, if any, may impose different frictional properties and image smearing pressure or frictional sensitivities between adjacent sheets being separated from one another by friction and/or pressure.

Disclosed in the embodiments herein is an improved document feeding system for duplex documents, for preventing or reducing the smudging or contamination of document sheets by the reverse-side image of a duplex document sheet when such sheets are being separated from a stack thereof in frictional retard nip types of document sheets separating and feeding systems for sequentially feeding document sheets for imaging, finishing or other processing from the stack thereof.

Retard type frictional sheet separator-feeders are in widespread use in document scanners, printers, copiers, interposers, inserters, collators, and other reproduction or finishing systems. Retard type separator-feeders typically have a frictional retard nip of elastomeric material, and a normal force system, such that the adjacent sheets are in relative frictional movement with one another during the separating-feeding cycles of document sheets being separated and fed from the stack of documents, especially in the retard nip, where the adjacent sheets may be pressed against one another by the nip normal force. A simplex document has a non-printed side facing the next, adjacent, document to be fed, and thus separation-feeding of simplex documents does not normally have the subject smearing problems that duplex documents can have.

The present system provides a simple, low-cost, yet effective, system for overcoming these and other problems in duplex document feeding by an improved, simple, cycling operation of a retard type document separator-feeder. It may even be incorporated into existing retard type document separator-feeders simply by a simple software control change in the operation thereof.

By way of background in document separator-feeders, one of the most difficult problems in feeding imaged sheets, including original document sheets being fed to be imaged, is separating and feeding the sheets sequentially, only one at a time, at the desired time, from a stack of sheets. That is, to avoid "double feeds", sheet overlaps, non-feeds, or other misfeeds. Sheets can vary widely in size and weight, stiffness, age, humidity, curl, size and other properties complicating the separation and feeding at the proper time of only one sheet at a time.

Some general examples of prior patents on retard-type spring reverse driven retard roller sheet separator-feeders are disclosed in Savin U.S. Pat. No. 4,368,881; and Konika U.S. Pat. No. 5,039,080. Other retard systems, with driven reverse rotation of retard rollers, instead of springs, are disclosed in U.S. Pat. Nos. 3,108,801, 2,979,330 and 4,801,134. Other retard sheet separators, and general principles thereof, including fixed retard pad systems, are described in Xerox Corporation U.S. Pat. No. 3,768,803 issued Oct. 30, 1993 to Klaus K. Stange.

Of particular interest to the specific semi-active retard separator-feeder of the specific embodiment herein is the above-cited copending application and Xerox Corporation U.S. Pat. No. 5,435,538 issued Jul. 25, 1995 to Philip A. Billings and Ermanno C. Petocchi; U.S. Pat. No. 5,421,569 issued Jun. 6, 1995 to Harry A. Davidson; U.S. Pat. No. 5,709,380 issued Jan. 20, 1998 to Ermanno C. Petocchi and Bruce J. DiRenzo; U.S. Pat. No. 5,769,410 issued Jun. 23, 1998 to Harry A. Davidson and Donald J. Lyon; U.S. Pat. No. 5,461,468 issued Oct. 24, 1995 to Neil J. Dempsey et al; and other patents cited therein. Said U.S. Pat. No. 5,461,468 is of particular interest for its document feeding timing and sequencing. Said U.S. Pat. No. 5,435,538 is of particular interest for its teaching of details of a frictional elastomer retard roller with an integral wrap spring slip biasing device to retard and separate underlying sheets while the top sheet is being fed out by a driven frictional elastomer feed wheel, forming the retard nip by a normal force engagement of the retard roll against the feed roll. The retard roll is allowed to slip-rotate in the downstream or forward sheet feeding direction, driven by the rotation of the feed roll, once the predetermined torque drag level is exceeded (in contrast to a fixed retard pad or roller). The rotational torque drag of the retard roll is set to provide considerable resistance to rotation, so that if two or more sheets are in the retard nip, normally only the one sheet engaged by the feed roll will be driven downstream out of the retard nip, and the others will be retarded there.

Of particular interest is U.S. Pat. No. 3,937,453 to Richard C. Hickey et al, which shows a multi-feed detection system where upon detection of more than one document passing through separator rollers, a clutch is energized to cause one of the rollers to rotate in a direction opposite of the other to separate the documents and only allow the top one to be forwarded.

Also of interest is U.S. Pat. No. 5,316,285 issued May 31, 1994 to Allan G. Olson, et al, disclosing a sheet feeder that has a sheets kick-back lever system for kicking back underlying sheets that may have partially advanced towards the feed zone by frictional forces between the fed sheet and the sheets beneath it.

Further by way of background, in sheet feeder-separator systems, including retard types, the single sheet being fed forward or downstream (while the other sheets are being retarded) is typically fed downstream to a "take-away" rolls nip located less than one sheet dimension downstream. The take-away nip positively engages and pulls the fed sheet on downstream, and may pull the rest of that sheet out of the retard nip (which is typically a less positive sheet engagement system with potential or actual slip, and/or overdriven or under-driven as compared to the takeaway rollers). Additionally, an upstream intermittently engaged elastomeric frictional nudger wheel, as also shown in above-cited references such as U.S. Pat. No. 5,461,468, may also engage the surface of the document sheet to be fed downstream and imaged over a platen imaging area.

As shown in the exemplary embodiments, the retard separator-feeder embodiment further described herein is utilized in a document feeder for reliably separating and sequentially feeding a variety of original document sheets to be scanned sequentially in an electronic image scanner. The embodiment here corresponds closely in that regard to the document handler of Xerox Corporation U.S. Pat. No. 5,534,989 issued Jul. 9, 1996 to Robert F. Rubscha et al.; U.S. Pat. 5,461,468 issued Oct. 24, 1995 to Neil J. Dempsey et al.; U.S. Pat. No. 5,339,139 issued Aug. 20, 1994 to Jack K. Fullerton, et al; and the above-cited U.S. Pat. No. 5,461,468; but this invention is not limited to that particular application.

The problems addressed herein could occur even if there was a fixed retard roll or pad in the separator-feeder. Even in the exemplary embodiment system, where the retard roll is being rotated forward, it is with high resistance, as the fed sheet is fed out of the retard nip (first by the feed roll and then by the downstream take-away rolls). The feed rolls in this embodiment must pull against and overcome the drag force set in the retard roller, which may be provided by an internal wrap spring as in the above-cited U.S. Pat. No. 5,435,538. This drag resistance of the retard roll may be considerable, e.g., 39 Newton-millimeters of torque.

In the description herein the term "document" or "sheet" refers to various flimsy physical sheets of paper, plastic, or other suitable physical image substrates.

A specific feature of the specific embodiment disclosed herein is to provide in a document separation and feeding system in which flimsy image bearing document sheets are separated and sequentially singularly fed downstream from an upstream stack thereof by a retard type sheet separator-feeder, said separator-feeder including a frictional elastomeric surface sheet feeding member operatively engaging a frictional elastomeric surface sheet movement resisting retard member to form a document sheet retarding nip for retarding the document sheets in said stack other than a single document sheet being fed by said sheet feeding member, wherein said retard member and said sheet feeding member engage one another with a normal force in said nip, and an intermittent drive system for intermittently driving said sheet feeding member; the improvement in separating and feeding duplex document sheets with images on both sides thereof with said separator-feeder comprising: (a) feeding said document sheets from said stack into said document sheet retarding nip, (b) operating said intermittent drive system to drive said sheet feeding member in said downstream sheet feeding direction for only a short document sheet feeding distance which is only a minor portion of the dimension of said document sheets, then (c) reversing said intermittent drive system to reverse drive said sheet feeding member in said upstream sheet feeding direction for only a short reverse document sheet feeding distance which is only a minor portion of the dimension of said document sheets to eject document sheets from said retard nip other than said single document sheet being fed by said sheet feeding member, then (d) operating said intermittent drive system to drive said sheet feeding member in said downstream sheet feeding direction for a much longer sheet feeding distance than said minor portion, for at least a substantial portion of the dimension of said document sheets, (e) so that said single document sheet being fed by said sheet feeding member may be fed downstream out of said nip without duplex document image smearing against other document sheets in said retard nip.

Further specific features disclosed herein, individually or in combination, include those wherein the document separation and feeding system of claim 1, wherein said retard type separator-feeder further includes an intermittently engaged elastomeric surface nudger wheel initially engaging said document sheets in said stack thereof upstream of said sheet feeding member for said feeding of said document sheets from said stack into said nip; and/or wherein in step (b) said short document sheet feeding distance is approximately 15 to 20 mm; and/or wherein in step (c) said short reverse document sheet feeding distance is approximately 6 mm; and/or wherein in step (c) said nudger wheel is out of engagement with said document sheets.

As to specific components of the subject apparatus, or alternatives thereof, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Figure 2:
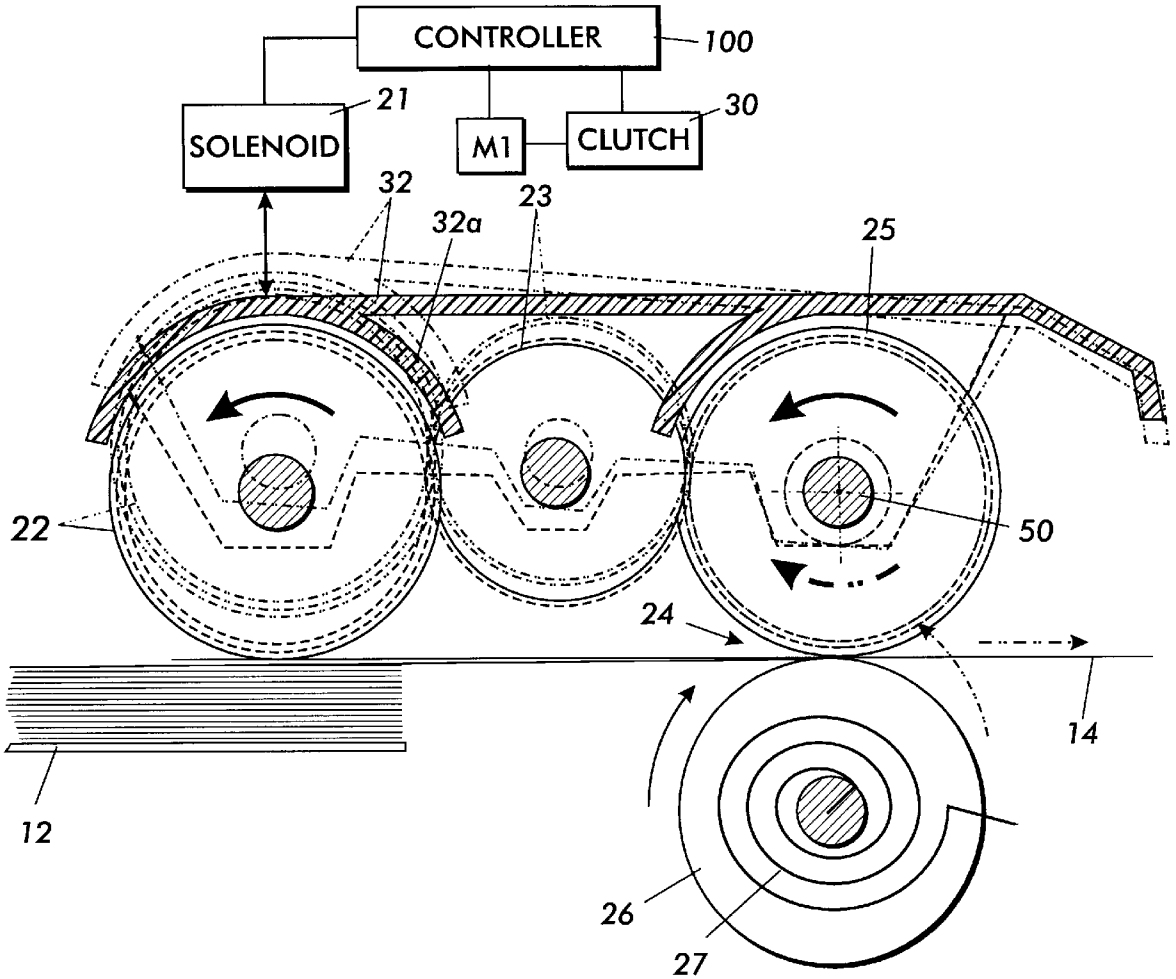
Figure 3:
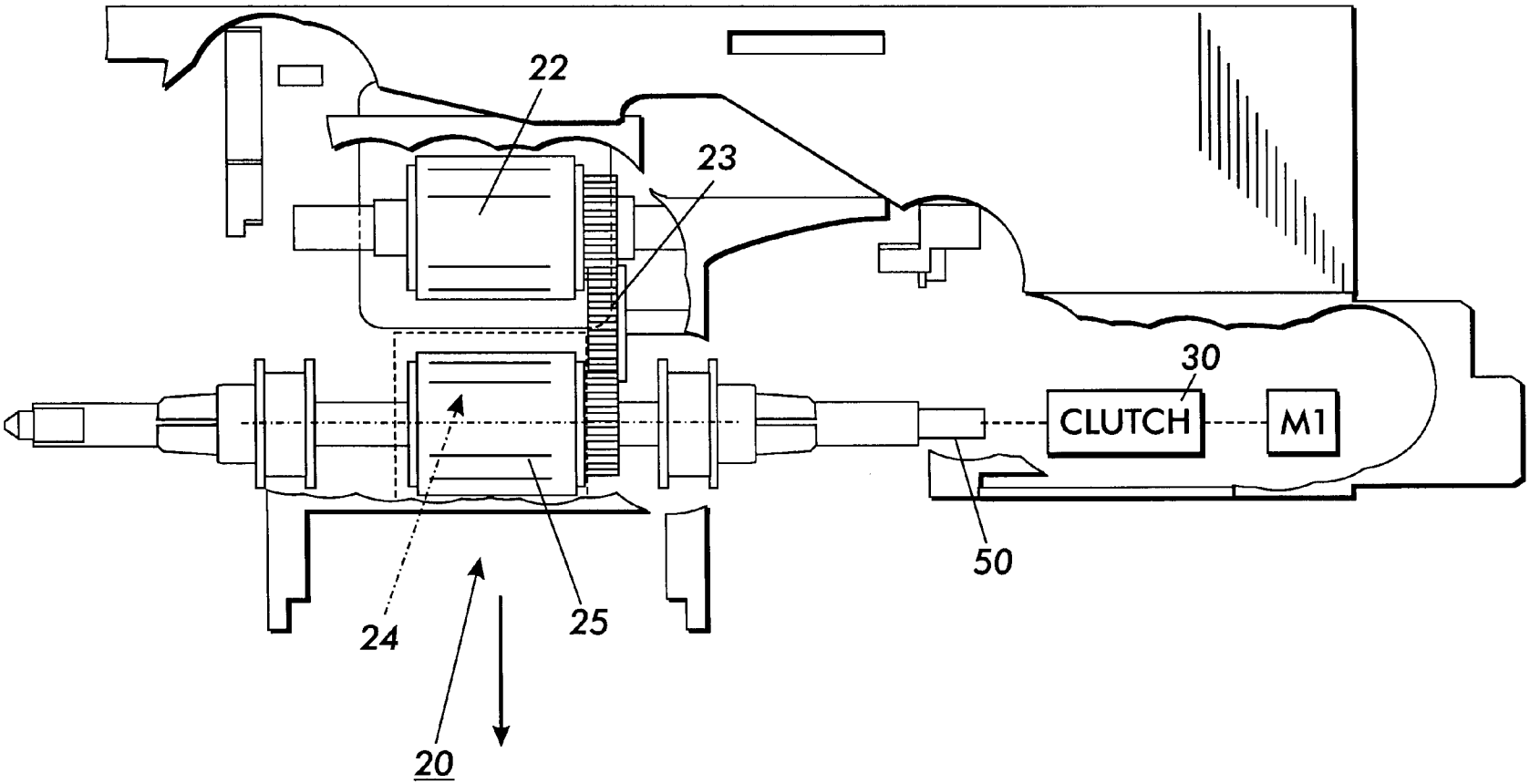

Various of the above-mentioned and further features and advantages will be apparent from the specific apparatus and its operation shown and described in the examples below, and from the abstract and claims. Thus, the present invention will be better understood from this description of specific exemplary embodiments, including the drawing figures (approximately to scale) wherein:

FIG. 1 schematically illustrates one example of a retard type sheet separator-feeder by which documents are separated from a stack thereof and fed sequentially, shown in this example a part of an exemplary document imaging system for feeding either simplex or duplex documents to a document image scanning station, in which the subject duplex document smearing prevention system may be utilized;

FIG. 2 is an enlarged and partly cross-sectional view of the retard separator-feeder embodiment of FIG. 1; and FIG. 3 is a partially broken away top view of the retard separator-feeder embodiment of FIGS. 1 and 2.

Referring first in general to the embodiment of FIGS. 1–3, as noted above, document handlers with an active or semi-active retard type document feeder/separator have a particular problem with smearing of document sheets with imaging material, such as toner or ink, from the adjacent facing side of a duplex document being fed, especially in the retard nip, where the documents can be pressed together with the nip normal force and one document moved relative to the other.

In the illustrated embodiment, the overall document handler 10 of FIG. 1 (more fully described in the above-cited patents thereon) has a document sheet stacking input tray 12 in which the document sheets to be imaged are stacked. The top sheets 14 from the sheets stacked in that tray 12 are sequentially fed from the tray 12 with an exemplary semi-active retard type sheet separator-feeder system 20 driven by a motor M1 and conventionally controlled by a controller 100. Briefly, in this exemplary separator-feeder system 20, a sheet 14 is separated from its underlying sheets, first by intermittent engagement (actuated by a solenoid 21) of the top sheet by a nudger roll 22 (driven by gear 23 driven off the drive of the feed roller 25). Overlapping sheets are then separated in a retard nip 24. The retard nip 24 here is defined by an underlying retard (drag) roller 26 engaged by a feed roller 25 intermittently driven by motor M1 through a clutch 30. The sheet 14 is then fed downstream by the feed roller 25 being driven by a drive shaft system 50 (shown in FIG.

3) connection to motor M1 when the electromagnetic clutch 30 is engaged by controller 100. The sheet 14 being fed out of the retard nip 24 by feed roller 25 is fed downstream to a driven takeaway roller nip 15 (which may also have a sheet acquisition sensor). The retard roller 26 may be torque biased for retarding sheets by an internal drag wrap spring 27. The retard system 20 here comprises a removable snap-in unit comprising the retard roller 26 and the feed roller 25, under a shield 32, as further disclosed in the above-cited patents thereon—U.S. Pat. Nos. 5,421,569, 5,709,380 and 5,769,410. The document sheet 14 that has been separated and fed out is fed downstream in a document feeding and inverting loop path 16 to the imaging station 17 which is a small area of the upper surface of the stationary platen glass 18, against which the moving document 14 is held down by a roller 19, while the document is being sequentially imaged through the platen glass 18 by the imager, here the "RIS" (raster input scanner) 90. After scanning, the document may be ejected by exit rolls 28 into the illustrated output tray or, if it is a duplex document, inverted and re-fed back through path 16, reversing the exit rolls 28 for imaging its second side, as explained in detail in the above-cited patents on that feature.

We will now further describe a specific example of the subject novel system and method of operation for separating and feeding duplex documents without smearing them, as applied in the above-described known example of a retard type sheet separator-feeder system 20 controlled by a controller 100. However, it should be noted again that this same problem can occur in various different friction retard, active retard systems, or semi-active (as here) retard systems. Referring particularly to FIG. 2, as in many retard type feeders, two or more sheets, or even a slug of sheets, may be driven into the retard zone or nip 24 by the nudger roll 22 feed before final separation occurs. That is, until only the one sheet directly engaged by the feed roller 25 (here the top sheet) is fed out, while the underlying sheets are held back in the retard nip 24 by (the spring 27 or other resistance provided to) the retard roller 26. The entrance angle of the nip 24 and the nip 24 normal force can thus press the sheet being fed out against the second or next underlying sheet while the fed sheet is moving relative thereto. That is, when a second sheet enters the retard nip during the feeding of a first sheet, the retard roll 26 stops rotating and sheet one slides out over sheet two, which is now stationary, while up to the bulk of the nip 24 normal force is being applied between the two sheets. If either one, or both, of the two adjacent sheets are duplex sheets, they will have a toner or ink image printed side facing and engaging the other sheet under pressure, which can smear onto the facing sheet in the nip. That is, the image on the backside of sheet one can partially offset onto, and thus smudge, the extreme lead edge of sheet two in the retard zone. Since sheet two will then also be fed to be imaged on that same, or both, sides in this document handler 10, the smear or smudge will be imaged and can appear on final copies or reproductions. This problem can, of course, occur throughout the feeding of an entire stack of documents where the entire stack comprises duplex documents or a mixture thereof.

The following method of operation to prevent or reduce this problem can be utilized for all sheet separation or feeding, or, only in response to the controller 100 input by the operator or connecting machine or network that a duplex document input mode has been selected. That is, retaining the prior method of operation of the separator-feeder 20 (described in more detail, for example, in the second of the two above-cited copending applications) for the simplex documents input mode.

The following are sequential operational steps for an exemplary method of operation of the exemplary retard separator-feeder 20 to reduce the above-described duplex document smudging:

Operate solenoid 21 to drop the rotating nudger roll 22 onto the top sheet 14 of the stack of document sheets in the input tray 12 for a sufficient time to feed sheets into the nip 24.

Turn on the feed clutch 30 to drive the feed roll 25 with motor M1 being driven forward for feeding sheets downstream.

Drive the feed roll 25, preferably at a slow speed, for a short downstream sheet feeding distance of only approximately 15 to 20 mm to feed the first or top sheet slightly downstream out of the nip 24. (Note that this short sheet feeding distance is only a minor portion of the 22 cm to 43 cm normal dimension in the feeding direction of the document sheets being fed, so that very little relative movement between sheets which could cause smearing is provided.)

Then, operate solenoid 21 to raise the nudger roll 22 up away from (out of engagement with) the stack of document sheets in the input tray 12.

Then, reverse drive motor M1 (preferably a conventional reversible motor) with feed clutch 30 engaged to reverse drive the feed roll 25 for about 6 mm to eject any underlying sheets in nip 24 back upstream out of nip 24, but not long enough or far enough to eject the first or top sheet back out of the nip 24.

Then, operate the feed motor M1 in the forward direction again for a much longer time and sheet feeding distance, sufficient to finish the normal downstream feeding out of the first or top sheet from the retard nip 24, without any other duplex sheets now being in the nip 24 to potentially cause image smearing, due to the above steps.

If the sheet retard separator-feeder system is instead of the active type, with a drive system (instead of a spring) actually reverse driving the retard roller, the below-claimed "intermittent drive system" for reverse driving the feed roll can be provided by unclutching the feed roll drive briefly, which allows the active retard roller drive to briefly reverse drive both rolls to clear the nip of all but the one sheet being fed out.

While the embodiments disclosed herein are preferred, it will be appreciated from this teaching that various alternatives, modifications, variations or improvements therein may be made by those skilled in the art, which are intended to be encompassed by the following claims. For example, frictional elastomer belts or pads may be usable in lieu of one or both of the above-described rollers.

What is claimed is:

1. In a document separation and feeding method in which flimsy image bearing document sheets are separated and sequentially singularly fed downstream from an upstream stack thereof by a retard type sheet separator-feeder, said separator-feeder including a frictional elastomeric surface sheet feeding member operatively engaging a frictional elastomeric surface sheet movement resisting retard member to form a closed document sheet retarding nip for retarding the document sheets in said stack other than a single document sheet being fed by said sheet feeding member, wherein said retard member and said sheet feeding member engage one another with a normal force in said closed document sheet retarding nip, and an intermittent drive system for intermittently driving said sheet feeding member; the improvement in separating and feeding document sheets with previously printed images with said separator-feeder comprising:

(a) feeding said document sheets from said stack into said document sheet retarding nip, (b) operating said intermittent drive system to drive said sheet feeding member in said downstream sheet feeding direction for only a short downstream document sheet feeding distance which is only a minor portion of the dimension of said document sheets, so that said single document sheet being fed by said sheet feeding member extends only partially downstream from said closed document sheet retarding nip, then (c) reversing said intermittent drive system to positively reverse drive said sheet feeding member in said upstream sheet feeding direction, while said sheet feeding member remains engaged with said retard member in said closed document sheet retarding nip for only a short reverse document sheet feeding distance which is only a minor portion of the dimension of said document sheets sufficient to eject document sheets from said retard nip other than said single document sheet being fed by said sheet feeding member, which short reverse document sheet feeding distance is less than said short downstream document sheet feeding distance so as to retain said single document sheet being fed by said sheet feeding member in said closed document sheet retarding nip, then (d) operating said intermittent drive system to positively drive said sheet feeding member in said downstream sheet feeding direction through said closed document sheet retarding nip, for at least a substantial portion of the dimension of said single document sheet, (e) so that said single document sheet being fed by said sheet feeding member may be positively fed downstream out of said closed document sheet retarding nip yet without document image smearing against other document sheets in said closed document sheet retarding nip.

2. The document separation and feeding method of claim 1, wherein said retard type separator-feeder further includes an intermittently engaged elastomeric surface nudger wheel initially engaging said document sheets in said stack thereof upstream of said sheet feeding member for said feeding of said document sheets from said stack into said closed document sheet retarding nip.

3. The document separation and feeding method of claim 1, wherein in step (b) said short downstream document sheet feeding distance is approximately 15 to 20 mm.

4. The document separation and feeding method of claim 1, wherein in step (c) said short reverse document sheet feeding distance is approximately 6 mm.

5. The document separation and feeding method of claim 2, wherein in step (c) said nudger wheel is moved out of engagement with said document sheets in said stack.

6. The document separation and feeding method of claim 1, wherein said step (c) is performed only in response to the indicated feeding of said document sheets with previously printed images which are duplex documents printed on both sides thereof.

* * * * *